US010336131B2

(12) United States Patent
D'Avino

(10) Patent No.: US 10,336,131 B2
(45) Date of Patent: Jul. 2, 2019

(54) CANVAS WITH SUPPORT

(71) Applicant: Alycia D'Avino, Huntington, NY (US)

(72) Inventor: Alycia D'Avino, Huntington, NY (US)

( * ) Notice: Subject to any disclaimer, the term of this patent is extended or adjusted under 35 U.S.C. 154(b) by 202 days.

(21) Appl. No.: 15/616,346

(22) Filed: Jun. 7, 2017

(65) Prior Publication Data

US 2017/0361645 A1 Dec. 21, 2017

Related U.S. Application Data

(60) Provisional application No. 62/350,558, filed on Jun. 15, 2016.

(51) Int. Cl.

| | |
|---|---|
| ***A47G 1/06*** | (2006.01) |
| ***B44D 3/18*** | (2006.01) |
| ***G09F 15/00*** | (2006.01) |

(52) U.S. Cl.

CPC ..... *B44D 3/185* (2013.01); *A47G 1/06* (2013.01); *G09F 15/0012* (2013.01); *A47G 2001/0661* (2013.01); *A47G 2001/0694* (2013.01)

(58) Field of Classification Search

CPC . A47G 1/142; A47G 2001/0694; B44D 3/185

USPC ..... 40/761, 762; 248/149, 150, 151, 460, 248/455, 456, 465, 472, 474, 469

See application file for complete search history.

(56) References Cited

U.S. PATENT DOCUMENTS

| | | | | |
|---|---|---|---|---|
| 2,876,973 | A * | 3/1959 | Spainhower | A47G 1/142 248/460 |
| 3,514,886 | A * | 6/1970 | Drakard | A47G 1/0605 40/735 |
| 6,347,466 | B1 * | 2/2002 | Lackner | B44D 3/185 38/102 |
| 6,435,512 | B1 * | 8/2002 | Beckwith, Sr. | F41J 1/10 273/403 |
| 2007/0266606 | A1 * | 11/2007 | Morgan | A47G 1/06 40/700 |
| 2018/0037053 | A1 * | 2/2018 | Murrow | B44D 3/185 |

* cited by examiner

*Primary Examiner* — Joanne Silbermann

(74) *Attorney, Agent, or Firm* — Scully, Scott, Murphy & Presser, PC

(57) ABSTRACT

The present disclosure is directed to a framed canvas. The framed canvas includes a frame including at least two sides, each of the at least two sides including a front surface and a rear surface, the rear surface of at least one of the at least two sides including a cavity, a canvas sheet contacting each of the at least two sides, and at least one support, the at least one support including a first end and a second end, the first end configured to extend into the cavity, the second end configured to contact a base.

4 Claims, 4 Drawing Sheets

CANVAS WITH SUPPORT

CROSS REFERENCE TO RELATED APPLICATIONS

This application claims priority to U.S. Provisional Application No. 62/350,558, filed on Jun. 15, 2016.

BACKGROUND OF THE DISCLOSURE

The set up and use of various canvases typically requires the use of an external support or frame, such as an easel, to maintain the canvas in a particular position and location. Since typical canvases cannot support themselves in a preferred position, the presence and use of external supports or frames becomes necessary.

What is desired is a device and method for using a canvas that can provide its own support. Embodiments of the present disclosure provide methods that address the above and other issues.

SUMMARY OF THE DISCLOSURE

The present disclosure is directed to a framed canvas known also as a "stretched canvas" and can also include a canvas with adhesive backing adhered to a substantially solid, planar panel, such as in a canvas board. The framed canvas includes a frame including at least two sides, each of the at least two sides including a front surface and a rear surface, the rear surface of at least one of the at least two sides including a cavity, a canvas sheet contacting each of the at least two sides, and at least one support, the at least one support including a first end and a second end, the first end configured to extend into the cavity, the second end configured to contact a base.

BRIEF DESCRIPTION OF THE DRAWINGS

The present disclosure will be better understood by reference to the following drawings of which.

DETAILED DESCRIPTION OF THE DISCLOSURE

Figure 1:
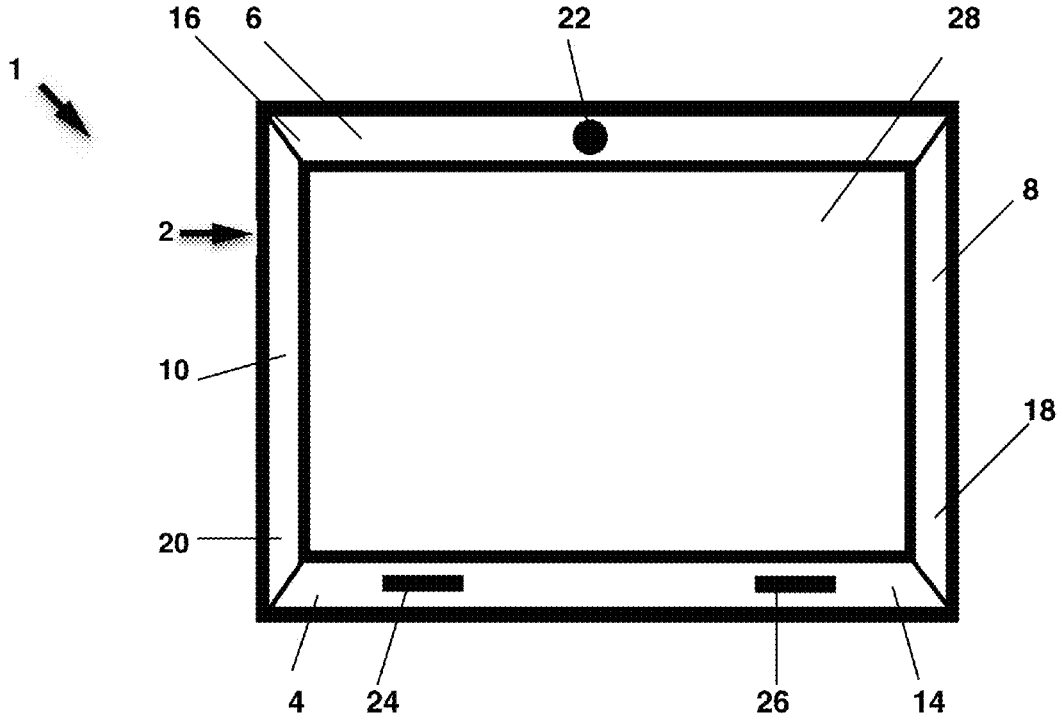
FIG. 1 is a plan view of a rear face of components of a framed canvas.

The present application will now be described in greater detail by referring to the following discussion and drawings that accompany the present application. It is noted that the drawings of the present application are provided for illustrative purposes only and, as such, the drawings are not drawn to scale. It is also noted that like and corresponding elements are referred to by like reference numerals.

In the following description, numerous specific details are set forth, such as particular structures, components, materials, dimensions, processing steps and techniques, in order to provide an understanding of the various embodiments of the present application. However, it will be appreciated by one of ordinary skill in the art that the various embodiments of the present application may be practiced without these specific details. In other instances, well-known structures or processing steps have not been described in detail in order to avoid obscuring the present application.

It will be understood that when an element as a layer, region or substrate is referred to as being "on" or "over" another element, it can be directly on the other element or intervening elements may also be present. In contrast, when an element is referred to as being "directly on" or "directly over" another element, there are no intervening elements present. It will also be understood that when an element is referred to as being "beneath" or "under" another element, it can be directly beneath or under the other element, or intervening elements may be present. In contrast, when an element is referred to as being "directly beneath" or "directly under" another element, there are no intervening elements present.

In the discussion and claims herein, the term "about" indicates that the value listed may be somewhat altered, as long as the alteration does not result in nonconformance of the process or structure to the illustrated embodiment. For example, for some elements the term "about" can refer to a variation of ±0.1%, for other elements, the term "about" can refer to a variation of ±1% or ±10%, or any point therein.

As used herein, the term "substantially", or "substantial", is equally applicable when used in a negative connotation to refer to the complete or near complete lack of an action, characteristic, property, state, structure, item, or result. For example, a surface that is "substantially" flat would either be completely flat, or so nearly flat that the effect would be the same as if it were completely flat.

As used herein terms such as "a", "an" and "the" are not intended to refer to only a singular entity, but include the general class of which a specific example may be used for illustration.

As used herein, terms defined in the singular are intended to include those terms defined in the plural and vice versa.

Reference herein to any numerical range expressly includes each numerical value (including fractional numbers and whole numbers) encompassed by that range. To illustrate, reference herein to a range of "at least 50" or "at least about 50" includes whole numbers of 50, 51, 52, 53, 54, 55, 56, 57, 58, 59, 60, etc., and fractional numbers 50.1, 50.2 50.3, 50.4, 50.5, 50.6, 50.7, 50.8, 50.9, etc. In a further illustration, reference herein to a range of "less than 50" or "less than about 50" includes whole numbers 49, 48, 47, 46, 45, 44, 43, 42, 41, 40, etc., and fractional numbers 49.9, 49.8, 49.7, 49.6, 49.5, 49.4, 49.3, 49.2, 49.1, 49.0, etc. In yet another illustration, reference herein to a range of from "5 to 10" includes whole numbers of 5, 6, 7, 8, 9, and 10, and fractional numbers 5.1, 5.2, 5.3, 5.4, 5.5, 5.6, 5.7, 5.8, 5.9, etc.

As used herein, the term "canvas" refers to any material capable of receiving paint, ink, wax-based materials such as crayons, oil-based materials such as colored pencils, and/or carbon based materials such as graphite and charcoal, including but not limited to canvas, cloths, fabrics, wallpapers, poster boards, papers, laminates, films and transparent films. The canvas may also include an adhesive backing and can also include an adhesive backing adhered to a substantially solid, planar panel, such as in a canvas board.

One embodiment of a framed canvas 1, known also as a "stretched canvas" is shown in FIG. 1.

The framed canvas includes a frame 2 that has at least two sides, a first side 4 and a second side 6. In this embodiment the first side 4 and the second side 6 are separated from each other by a third side 8 and a fourth side 10, but in other embodiments, first side 4 and second side 6 can be joined directly together to form a frame perimeter. In other embodiments, the frame 2 can include two, three, five or more sides, but for exemplary purposes, frame 2 is described and shown as has having four sides. Although each of the first side 4, second side 6, third side 8 and fourth side 10 are shown and referred to as "sides" of a substantially rectangular shaped frame 2, these "sides" could be areas of a substantially elliptical or substantially circular shaped frame.

Each of the sides of frame 2 can be joined together in any suitable way, such as with an adhesive and/or by a mechanical connector such as nails, staples, etc.

In this view, a first side rear surface 14, a, second side rear surface 16, a third side rear surface 18 and a fourth side rear surface 20 are shown. A front surface of each of these sides is not shown but opposes the rear surface of each side.

In this embodiment, the second side rear surface 16 includes a first cavity 22. In this embodiment, first cavity 22 is substantially round, but in other embodiments first cavity 22 can be any other shape, including elliptical shapes and shapes with three, four or more sides. Also in this embodiment, the first side rear surface 14 includes a second cavity 24 and a third cavity 26. In this embodiment, the second cavity 24 and the third cavity 26 are substantially rectangular, but in other embodiments the second cavity 24 and the third cavity 26 can be any other shape, including substantially circular, substantially elliptical or be a shape with three, five or more sides.

In this embodiment, each of the first cavity 22, second cavity 24 and third cavity 26 extends through a portion of the thickness of the second side 6 and the first side 4, respectively. In other embodiments, each of the first cavity 22, second cavity 24 and third cavity 26 can extend through the entire thickness of the second side 6 and the first side 4, respectively.

Figure 2:
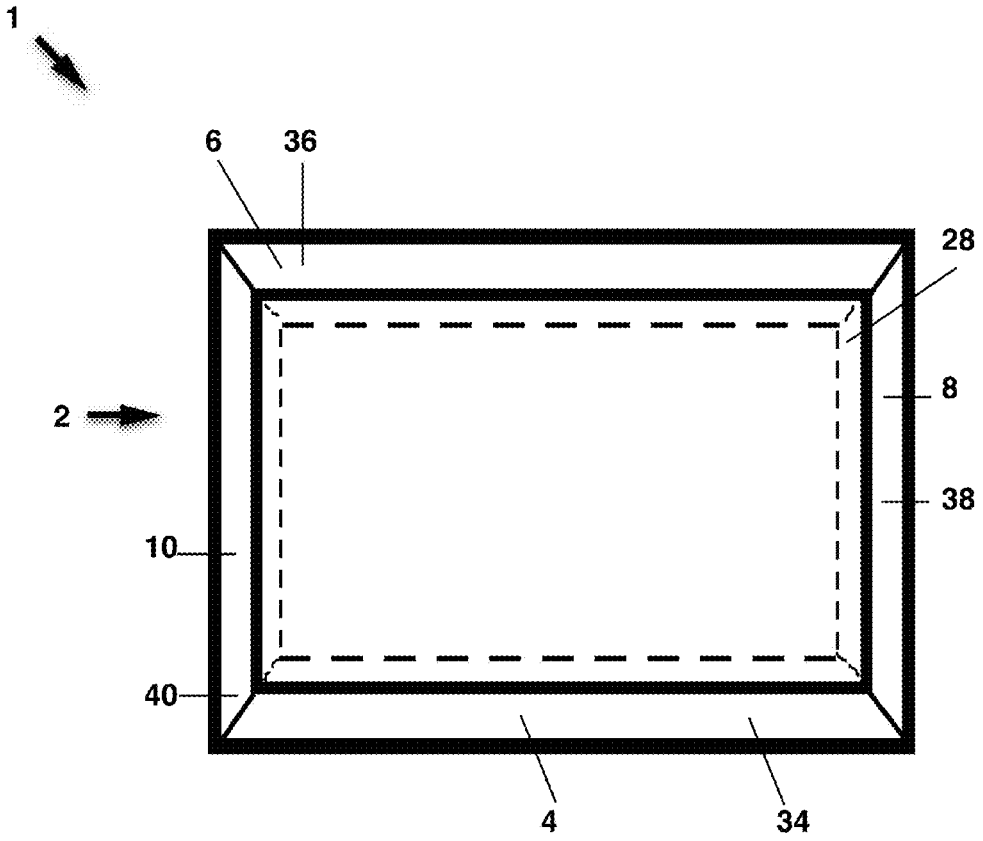
FIG. 2 is a plan view of a front face of components of a framed canvas.

In this embodiment, a canvas sheet 28 contacts the first side 4 and the second side 6, and is better illustrated in FIG. 2. The canvas sheet 28 can be secured to frame 2 in any suitable way, such as with an adhesive and/or by a mechanical connector such as nails, staples, etc.

Referring to FIG. 2, in this view, a first side front surface 34, a second side front surface 36, a third side front surface 38 and a fourth side front surface 40 are shown. The canvas sheet 28 is shown as contacting the first side 4 and the second side 6, as well as third side 8 and fourth side 10.

In this embodiment, canvas sheet 28 covers a portion of each of the first side front surface 34, the second side front surface 36, the third side front surface 38 and the fourth side front surface 40. But, in other embodiments, the canvas sheet 28 can contact a smaller portion or larger portion of each of the first side front surface 34, the second side front surface 36, the third side front surface 38 and the fourth side front surface 40.

Figure 3:
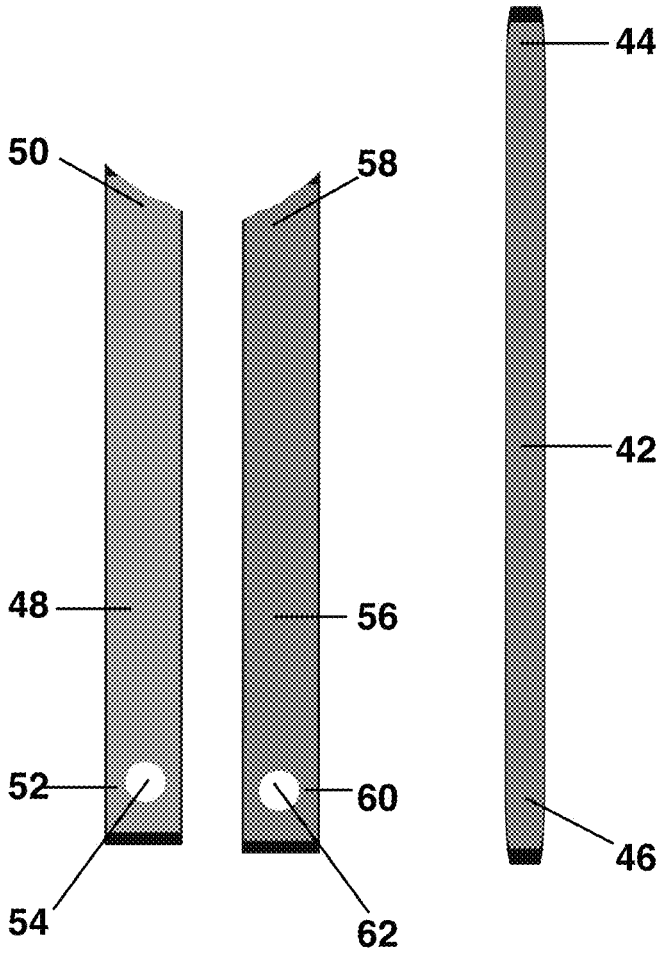
FIG. 3 is a plan view of first, second and third supports.

FIG. 3 shows a first support 42, a second support 48 and a third support 56. The first support 42 includes a first support first end 44 and a first support second end 46. The second support 48 includes a second support first end 50 and a second support second end 52. The third support 56 includes a third support first end 58 and a third support second end 60. In this embodiment, the second support 48 and the third support 56 are optional.

In this embodiment, the first support first end 44 is configured to extend into the first cavity (22 of FIG. 1), with the first support second end 46 configured to contact a base, such as a table. The length of the first support 42 can be adjusted based on size of framed canvas 1 and desired angle of frame canvas 1 in relation to the base, such as a table.

In this embodiment, the second support first end 50 is configured to extend into the second cavity (24 of FIG. 2) and the third support first end 58 is configured to extend into the third cavity (26 of FIG. 2).

In this embodiment, the first support 42 is substantially round, but in other embodiments first support 42 can be any other shape, including elliptical shapes and shapes with three, four or more sides. In this embodiment, the second support 48 and the third support 56 are substantially rectangular, but in other embodiments the second support 48 and the third support 56 can be any other shape, including substantially circular, substantially elliptical or be a shape with three, five or more sides.

In this embodiment each of the second support 48 and the third support 56 includes a void. The second support second end 52 includes a first void 54 and the third support second end 60 includes a second void 62. Each of the first void 54 and the second void 62 can extend through the depth of the second support 48 and the third support 56, respectively.

In this embodiment the first void 54 and the second void 62 can be of a shape that substantially correlates to the shape of the first support 42. Also, the first void 54 and the second void 62 can extend through the depth of each of the second support 48 and the third support 56, respectively. The first support second end 46 can extend through one or both of the first void 54 and the second void 62.

Each of the first side 4, the second side 6, the third side 8 and the fourth side 10—(shown in FIG. 1) and the first support 42, second support 48 and third support 56 can be formed of the same or different materials. These materials can be any that are suitable of substantially maintaining their shapes during use, such as wood, paper, glass, plastic, metal, rubber, carbon based materials, and mixtures thereof.

Figure 4:
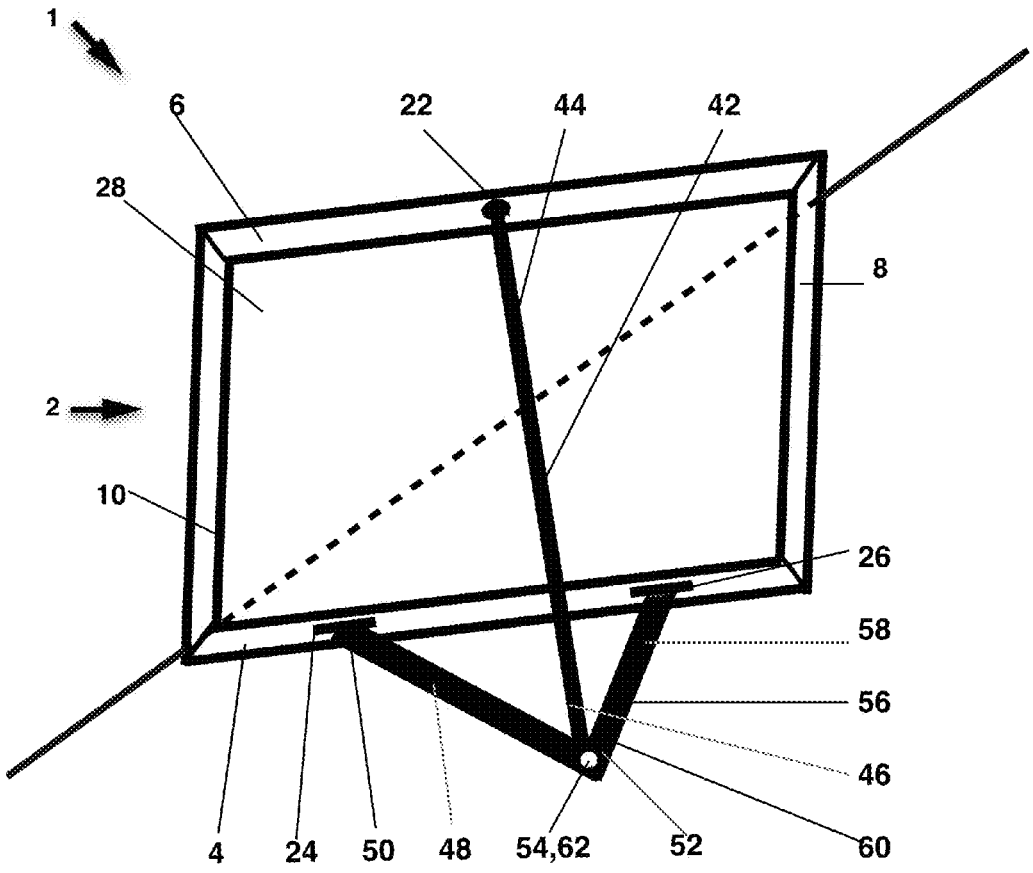
FIG. 4 is a perspective view of the rear face of an assembled, framed canvas.

A perspective view of the framed canvas 1, including frame 2, first support 42, second support 48 and third support 56 is shown in FIG. 4, in an assembled configuration, on a base 64. Although FIG. 4 illustrates framed canvas 1 resting on the first side 4, second support 48, third support 56 and the first support second side (which has extended through the first void 54 and the second void 62 and contacts the base 64), in other configurations, the framed canvas can be placed on a base in any suitable orientation.

Each of the first side 4, the second side 6, the third side 8, the fourth side 10, the first support 42, second support 48 and third support 56 are shown having relative dimensions as those shown in FIG. 4, but in other embodiments the dimensions of each of these components is fully adjustable and frame 2 can be formed in any orientation.

The described embodiments and examples of the present disclosure are intended to be illustrative rather than restrictive, and are not intended to represent every embodiment or example of the present disclosure. While the fundamental novel features of the disclosure as applied to various specific embodiments thereof have been shown, described and pointed out, it will also be understood that various omissions, substitutions and changes in the form and details of the devices illustrated and in their operation, may be made by those skilled in the art without departing from the spirit of the disclosure. For example, it is expressly intended that all combinations of those elements and/or method steps which perform substantially the same function in substantially the same way to achieve the same results are within the scope of the disclosure. Moreover, it should be recognized that structures and/or elements and/or method steps shown and/or described in connection with any disclosed form or embodiment of the disclosure may be incorporated in any other disclosed or described or suggested form or embodiment as a general matter of design choice. Further, various modifications and variations can be made without departing from the spirit or scope of the disclosure as set forth in the following claims both literally and in equivalents recognized in law.

The invention claimed is:

1. A framed canvas, the framed canvas comprising:

a frame comprising at least two sides, each of the at least two sides comprising a front surface and a rear surface, wherein one of the at least two sides comprises a round cavity in the rear surface and another of the at least two sides comprises two rectangular cavities in the rear surface;

a canvas sheet contacting each of the at least two sides; and at least one support, the at least one support comprising a first end and a second end, wherein one of the at least one supports has a round cross-section and two other of the at least one supports have rectangular cross sections, wherein a first end of the at least one support having the round cross section is configured to extend into the round cavity and a first end of the two at least one supports having the rectangular cross-sections are configured to extend into the two rectangular cavities, wherein a second end of the at least one support having the round cross section is configured to extend into a void in a second end of each of the two at least one support having the rectangular cross-sections.

2. The framed canvas of claim 1, wherein the frame comprises four sides that join together to form a frame perimeter.

3. The framed canvas of claim 1, wherein the canvas sheet extends over at least a portion of the front surfaces of each of the at least two sides.

4. The framed canvas of claim 1, wherein the canvas sheet extends over the front surface of each of the at least two sides.

* * * * *